US008201496B1

(12) United States Patent
Tersteeg

(10) Patent No.: US 8,201,496 B1
(45) Date of Patent: Jun. 19, 2012

(54) BIOMASS HARVESTER COMPRESSOR SYSTEM

(76) Inventor: Randy J. Tersteeg, Olivia, MN (US)

( * ) Notice: Subject to any disclaimer, the term of this patent is extended or adjusted under 35 U.S.C. 154(b) by 401 days.

(21) Appl. No.: 12/428,197

(22) Filed: Apr. 22, 2009

(51) Int. Cl.
*B30B 15/34* (2006.01)
*B30B 9/30* (2006.01)
*B30B 7/04* (2006.01)

(52) U.S. Cl. ..... 100/92; 100/317; 100/98 R; 100/178; 100/232; 100/245

(58) Field of Classification Search ..... 100/92, 100/317, 94, 97, 98 R, 178, 179, 232, 240, 100/245, 906; 56/341
See application file for complete search history.

(56) References Cited

U.S. PATENT DOCUMENTS 1,908,689 A 5/1933 Carpenter
2,194,593 A 3/1940 Graham
3,706,209 A * 12/1972 Gehlen et al. ..... 62/341
4,044,569 A * 8/1977 Harza ..... 62/341
4,211,740 A 7/1980 Dean et al.
4,260,573 A 4/1981 Overman
4,308,033 A 12/1981 Gunnerman
4,511,321 A 4/1985 Howard
4,782,667 A * 11/1988 Kito et al. ..... 62/354
4,834,777 A 5/1989 Endebrock
4,859,211 A 8/1989 Moore
5,658,608 A * 8/1997 Klefbeck ..... 426/512
6,099,770 A 8/2000 Akers et al.
6,375,447 B1 4/2002 Zitron et al.
2007/0006526 A1 1/2007 Cullen
2008/0057282 A1 3/2008 Bishop et al.

* cited by examiner

*Primary Examiner* — Jimmy T Nguyen
(74) *Attorney, Agent, or Firm* — Neustel Law Offices

(57) ABSTRACT

A biomass harvester compressor system for efficiently harvesting and compacting biomass. The biomass harvester compressor system generally includes a harvester for harvesting a biomass crop and a compressor following behind the harvester for being fed the harvested biomass crop. The compressor includes at least one compacting device for compacting the biomass, at least one freezing assembly for freezing the biomass and at least one cutting mechanism for cutting the biomass after the freezing.

1 Claim, 10 Drawing Sheets

BIOMASS HARVESTER COMPRESSOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to harvesters and more specifically it relates to a biomass harvester compressor system for efficiently harvesting and compacting biomass.

2. Description of the Related Art

Any discussion of the related art throughout the specification should in no way be considered as an admission that such related art is widely known or forms part of common general knowledge in the field.

Harvesters have been in use for years. Biomass products generally require a large degree of compaction when harvesting in order to efficiently transport the biomass in a cost and time effective manner.

Prior compactors have failed to provide an efficient manner in which to compact the biomass for various reasons, such as the great expense in purchasing and operating the compactors, as well as their inability to fully compact the biomass. The inefficiency in prior compactors can be especially noticeable to farmers who may be struggling due to increased fuel costs and/or below average crop yields. Because of the inherent problems with the related art, there is a need for a new and improved biomass harvester compressor system for efficiently harvesting and compacting biomass.

BRIEF SUMMARY OF THE INVENTION

A system for efficiently harvesting and compacting biomass. The invention generally relates to a harvester which includes a harvester for harvesting a biomass crop and a compressor following behind the harvester for being fed the harvested biomass crop. The compressor includes at least one compacting device for compacting the biomass, at least one freezing assembly for freezing the biomass and at least one cutting mechanism for cutting the biomass after the freezing.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
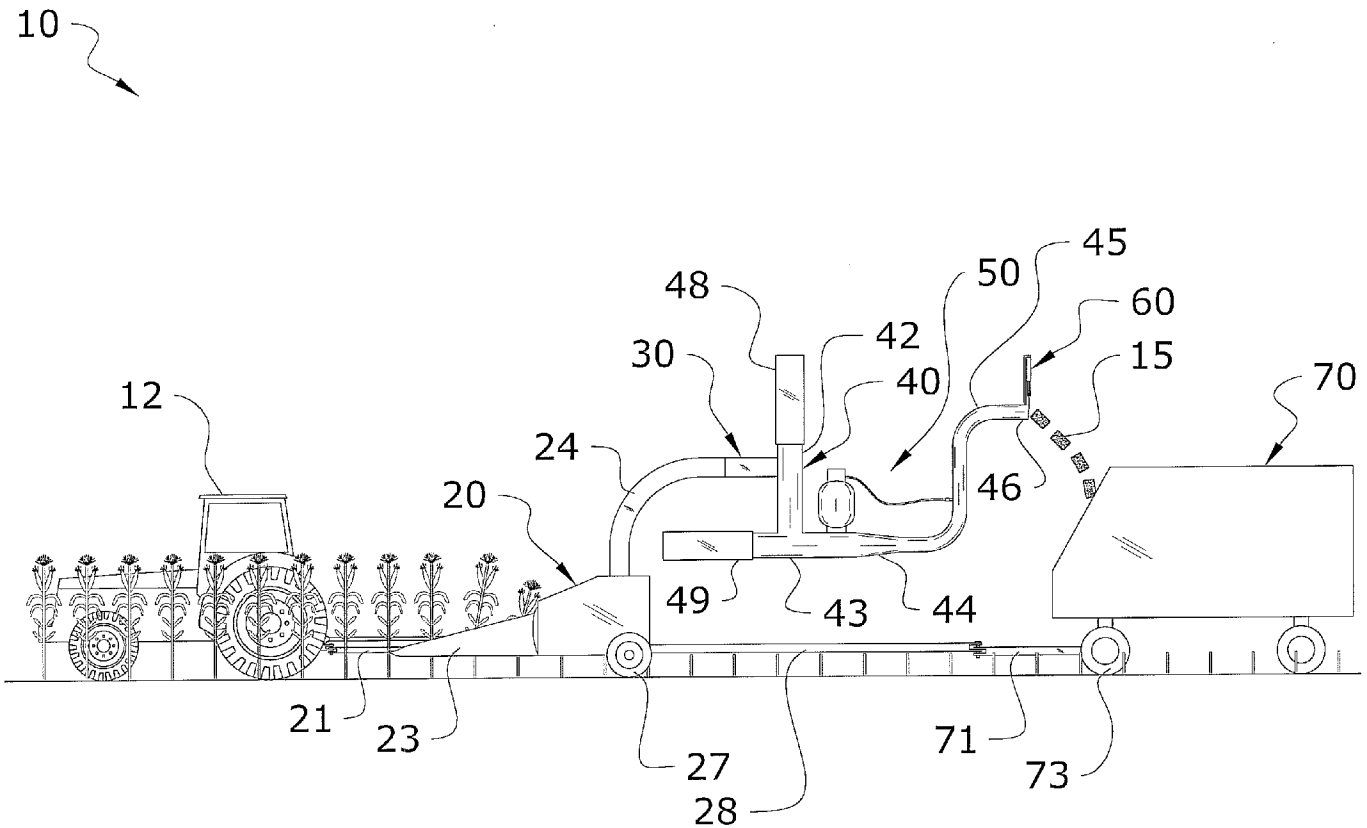
FIG. 1 is an illustrative side view of the present invention in use.

Turning now descriptively to the drawings, in which similar reference characters denote similar elements throughout the several views, FIGS. 1 through 10 illustrate a biomass harvester compressor system 10, which comprises a harvester 20 for harvesting biomass 15 and a compressor 30 following behind the harvester 20 for being fed the harvested biomass 15. The compressor 30 includes at least one compacting device 48, 49 for compacting the biomass 15, at least one freezing assembly 50 for freezing the biomass 15 and at least one cutting mechanism 60 for cutting the biomass 15 after the freezing.

It is appreciated that the biomass 15 may be comprised of alternate types of compressible material similar to or different from biomass 15. Other types of compressible material may include other agricultural products or any other type of material. The compressor 30 thus may be used with or without a harvester 20, wherein the compressible material may be fed within the compressor 30 from various types of machinery.

B. Harvester

The harvester 20 is utilized to harvest the biomass 15 or other type of crop as illustrated in FIG. 1. The harvester 20 may be comprised of a combine or other type of harvesting mechanism and performs various functions (e.g. harvesting crops, threshing crops, cleaning crops, etc.) common in the art of combines and harvesting biomass 15 or crops. The harvester 20 may be comprised of a drivable configuration including an engine and a plurality of wheels 27 or may be pulled behind another tractor 12 or combine type agricultural vehicle.

The head 23 of the harvester 20 is also preferably comprised of a grain combine head common in the art of harvesting grain, an "all crop head" commonly utilized for the harvest of sunflower and corn seed and biomass 15, a stalk chopper, a chopping and suction head, or the like. In the preferred embodiment, the harvester 20 includes a tongue 21 to be attached to a hitch 28 of a tractor 12, wheels 27 (wherein the harvester 20 is a pull behind type) and a hitch 28 to secure the wagon 70 behind thereof. However, various types of harvesters 20 may be appreciated with the present invention rather than those described and illustrated. The harvester 20 may also be a self-propelled unit with the head 23 in front of the harvester 20.

The harvester 20 includes a conveyor 24 in communication with the head 23 to transfer the harvested biomass 15 or other crops to the compressor 30. The conveyor 24 may be comprised of various types, such as an auger, belt, or the like, all which efficiently transfer the biomass 15 to the compressor 30. The conveyor 24 and harvester 20 may further be powered through various sources, such as through the tractor 12 or an independent power supply.

C. Compressor

The compressor 30 is used to compress or compact the biomass 15 so that the biomass 15 may be more efficiently stored, transported or measured. The compressor 30 may be comprised of various sizes to accommodate the respective amount of biomass 15 that must be harvested and compressed as well as the speed in which the biomass 15 must be harvested and compressed. Various supports or power supplies common in the art of agricultural machinery may be used to support or secure the compressor 30 as needed. Also, various power supplies may be used to provide power to the compressor 30.

The preferred embodiment of the compressor 30 includes a manifold 31 that is in communication with the conveyor 24 of the harvester 20. The manifold 31 includes a primary inflow portion 32 to receive the loose biomass 15 from the conveyor 24. The primary inflow portion 32 connects with a plurality of secondary inflow portions 41 at a Y-shaped or other shaped intersection.

Figure 9:
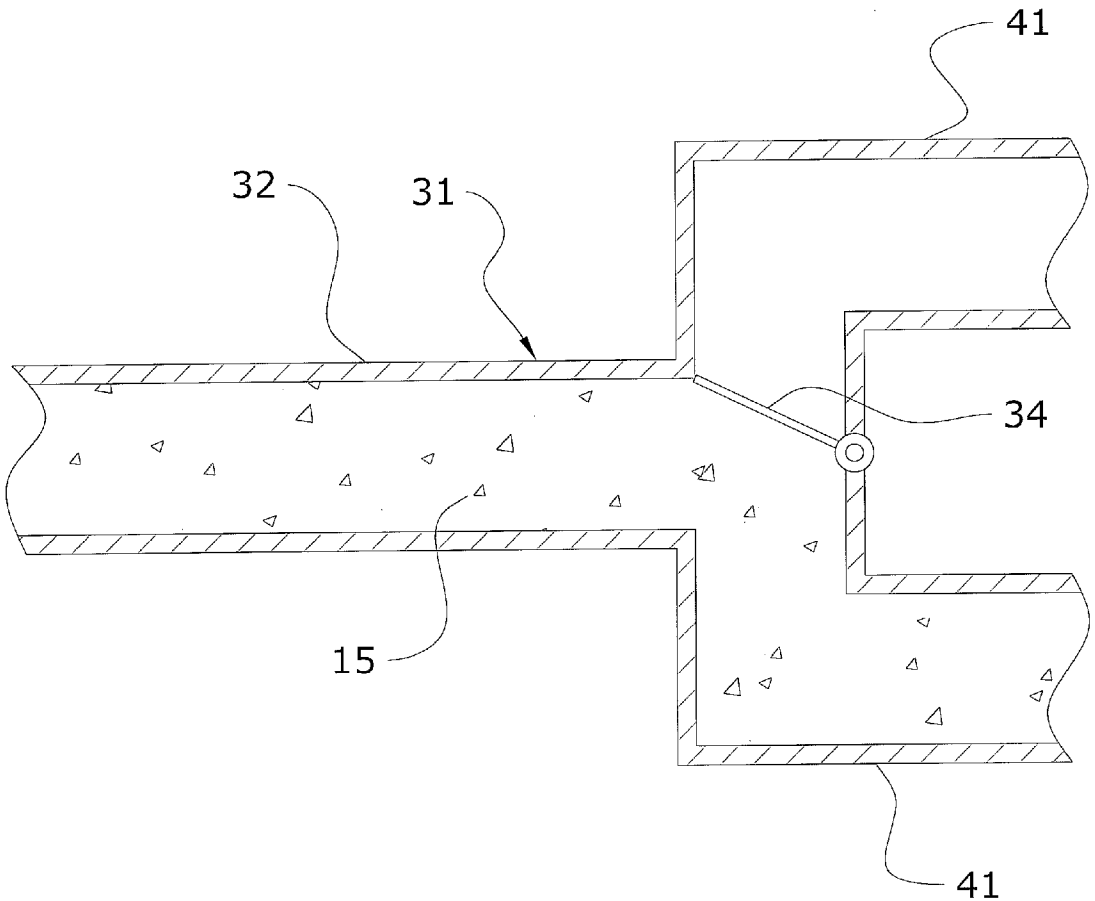
FIG. 9 is a top sectional of the manifold where the gate is in a first position to direct the loose biomass within a first compression tube.
Figure 10:
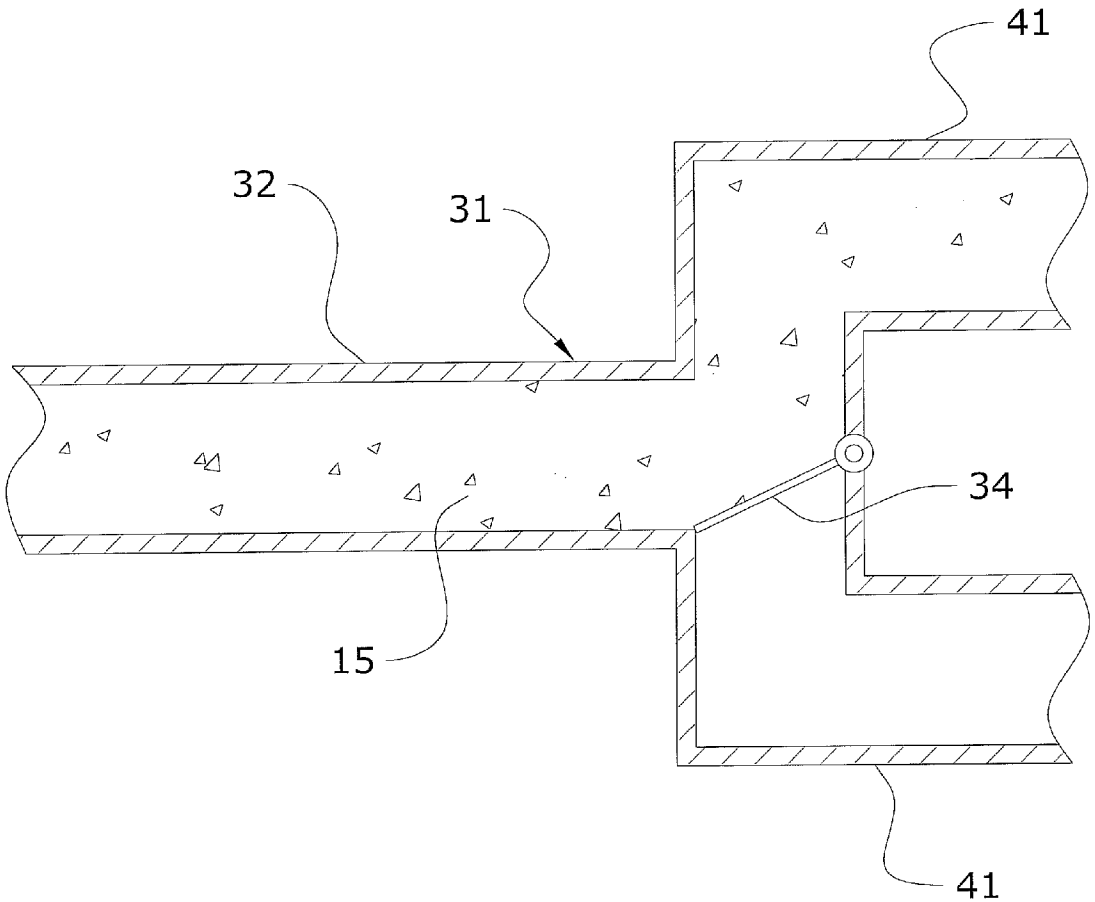
FIG. 10 is a top sectional of the manifold where the gate is in a second position to direct the loose biomass within a second compression tube.

A valve 34 is used to divert the biomass 15 from the primary inflow portion 32 to a respective secondary inflow portion 41 as illustrated in FIGS. 9 and 10. The valve 34 may be comprised of a flap, gate or various other configurations that are capable of efficiently diverting the biomass 15. The valve 34 may be powered by a standalone motor 35 or through various other power supplies. The valve 34 may be controlled via the operator of the compressor 30, set on a timer to alternate positions in a periodic manner, or may be in communication with the compressor 30 to move when a particular secondary inflow portion 41 is ready to receive the biomass 15.

Figure 2:
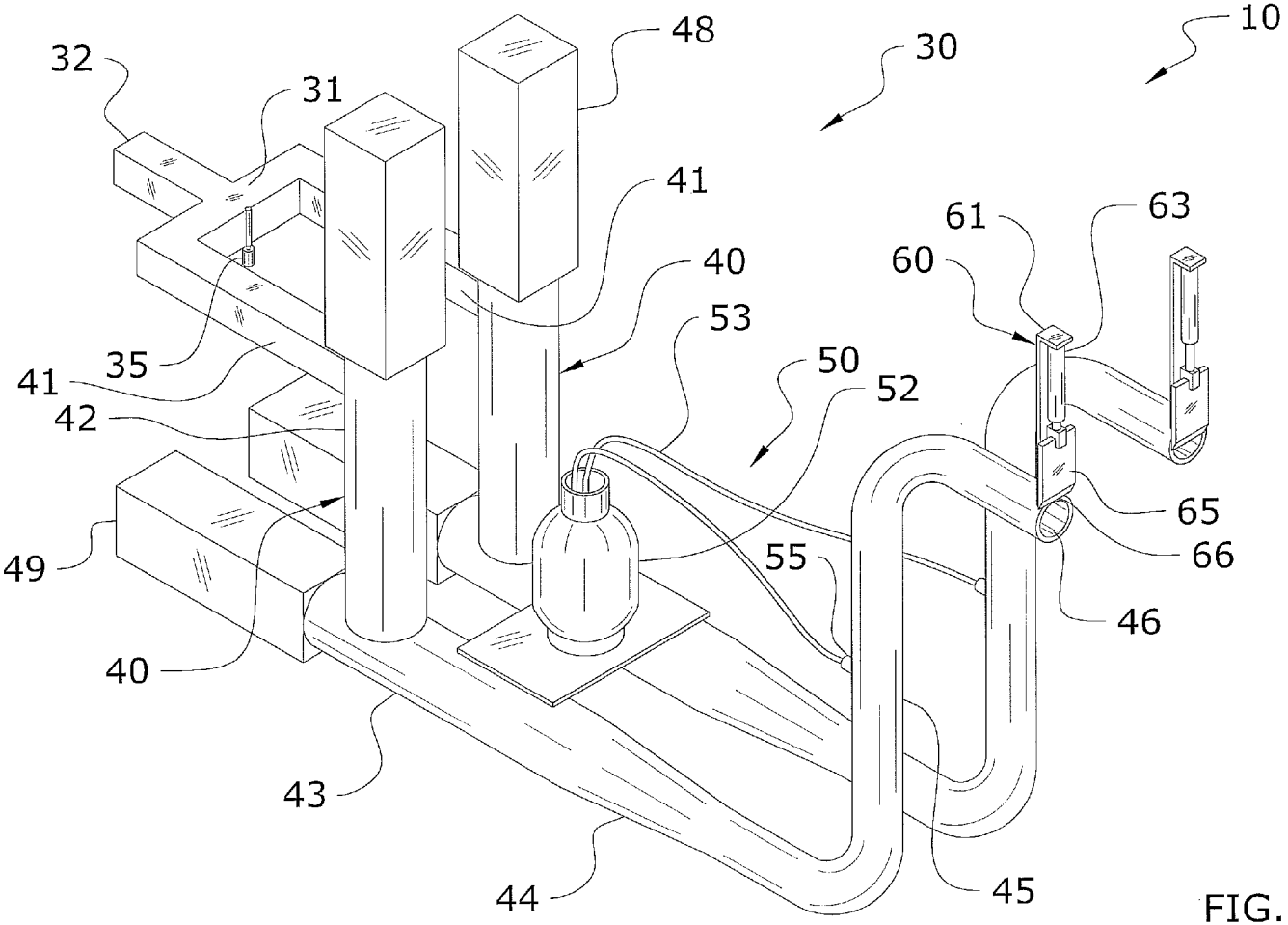
FIG. 2 is an upper perspective view of the compressor illustrating the multiple compression tubes.

Each secondary inflow portion 41 leads to a different compression tube 40 of the compressor 30. The compression tubes 40 of the compressor 30 are all preferably comprised of similar configurations and are present to increase the speed of the compressing of the biomass 15. The compression tubes 40 further work in parallel and are generally positioned side-by-side as illustrated in FIG. 2. It is appreciated that two compression tubes 40 are illustrated in FIG. 2; however more or less compression tubes 40 may be used with the compressor 30 depending upon how large of a compressor 30 is desired. Likewise the number of secondary inflow portions 41 varies along with the number of compression tubes 40 of the compressor 30.

Each compression tube 40, pair or group of compression tubes 40 also preferably work in an alternating or offset manner, wherein the compression tubes 40 will be operating at different stages of a compression cycle (i.e. compacting, freezing, or cutting) so that at least one of the compression tubes 40 will be able to continually fed biomass 15 from the conveyor 24 and manifold 31. The compression tubes 40 will herein be described in a singular manner; however it is appreciated that each compression tube 40 includes identical components and is capable of operating each step of the compression cycle.

The compression tube 40 includes a first segment 42 in communication with the respective secondary inflow portion 41. The first segment 42 is preferably oriented in a vertical manner and perpendicular with the horizontally positioned secondary inflow portion 41. The secondary inflow portion 41 preferably connects with the first segment 42 near an upper end of the first segment 42 so that the first segment 42 may be filled more completely with the loose biomass 15.

A first compacting device 48 is preferably located above the first segment 42 and aligned with the first segment 42. The first compacting device 48 may be comprised of various configurations, such as but not limited to a hydraulic cylinder and operates to extend within the first segment 42 to compact the biomass 15 towards the second segment 43.

The second segment 43 is in communication with the first segment 42. The second segment 43 is preferably oriented in a horizontal manner and perpendicular with the vertically positioned first segment 42. The first segment 42 tube preferably connects with the second segment 43 near an inner end of the second segment 43 so that the second segment 43 may be filled more completely with the biomass 15. The first segment 42 and the second segment 43 are also generally comprised of structures of a uniform diameter in portions in which the first compacting device 48 and the second compacting device 49 extend.

A second compacting device 49 is preferably located behind the second segment 43 (in a flow of the biomass 15 through the compressor 30) and aligned with the second segment 43. The second compacting device 49 may be comprised of various configurations, such as but not limited to a hydraulic cylinder and operates to extend within the second segment 43 to compact the biomass 15 towards the third segment 45.

A tapered portion 44 extends from the second segment 43 opposite the second compacting device 49 to further compact the biomass 15, wherein the biomass 15 is forced within the inwardly tapered portion 44 by the second compacting device 49. Extending from the tapered portion 44 is the third segment 45.

The inlet of the third segment 45 extends in a horizontal manner to concentrically align with the tapered portion 44. The third segment 45 is subsequently comprised of a smaller diameter than both the first segment 42 and the second segment 43. It is appreciated that the first segment 42 and the second segment 43 are comprised of similar diameters (minus the tapered portion 44).

The third segment 45 extends in a snake-like manner from a horizontal direction near the tapered portion 44 to a vertical alignment so that the biomass 15 within the third segment 45 can extend sufficiently high above ground to be able to drop within the wagon 70' following behind. Extending from the vertical portion of the third segment 45 is a horizontal portion that leads to the outlet 46 of the third segment 45 and compressor 30. It is appreciated that the first segment 42, the second segment 43 and the third segment 45 are preferably comprised of an integral structure.

A freezing assembly 50 operates while the biomass 15 travels through the third segment 45. The freezing assembly 50 generally includes a tank 52 that is shared between the compression tubes 40. The tank 52 is filled with a coolant 57 that is fed within the third segment 45 via a hose 53 and nozzle 55. The coolant 57 is generally fed at the vertical portion of the third segment 45 and acts to further compress the biomass 15. The coolant 57 may be comprised of various types, such as but not limited to anhydrous, liquid nitrogen or various others. The coolant 57 may be various compositions, such as a liquid or a gas.

Located near the outlet 46 of the compressor 30 and third segment 45 is the cutting mechanism 60. The cutting mechanism 60 acts to cut the compressed biomass 15 into smaller sized pieces or pellets. The cutting mechanism 60 generally includes a support 61 extending from the third segment 45 near the outlet 46 that secures a vertically positioned actuator 63. The actuator 63, comprised of a hydraulic cylinder or various other configurations, acts to force a connected blade 65 across the outlet 46 and thus through a portion of the compressed biomass 15. The blade 65 thus includes a cutting surface 66 positioned along a lower end of the blade 65, wherein the blade 65 acts in a reciprocating manner in cutting the compressed biomass 15 that is passing through the outlet 46.

D. Wagon

The wagon 70 may be comprised of various configurations all which efficiently catch and carry the compressed biomass 15 from the compressor 30. The wagon 70 preferably includes wheels 73 and a tongue 71, wherein the tongue 71 attaches to the hitch 28 of the harvester 20 via a pin or ball. It is appreciated that the wagon 70 may also attach to the compressor 30 via the tongue 71 and hitch 28 or may be fixedly attached to the compressor 30 or the harvester 20.

E. Operation of Preferred Embodiment

Figure 3:
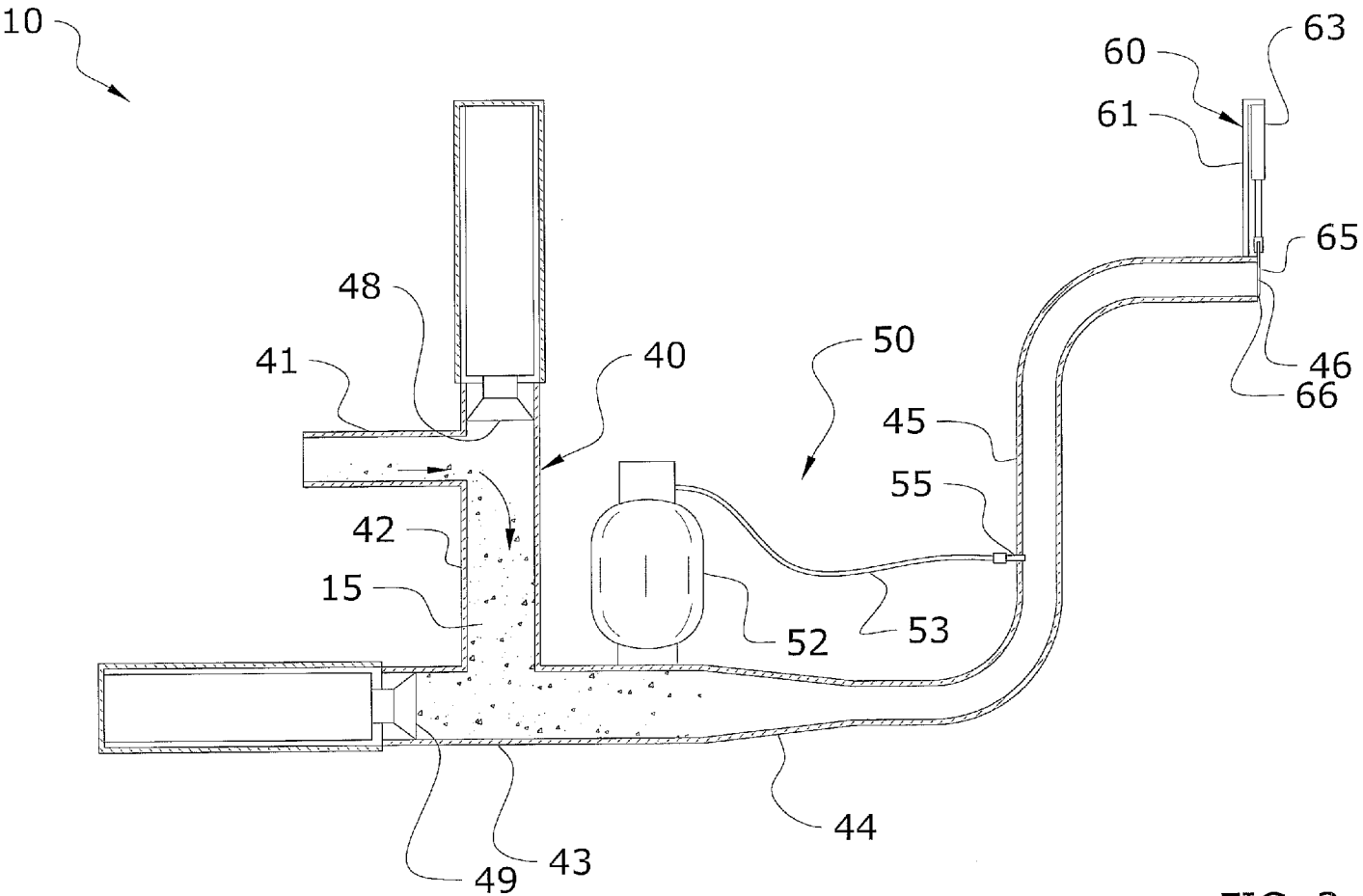
FIG. 3 is a side sectional view of the compressor where the biomass is being fed into the first and second segments of the compression tube.
Figure 4:
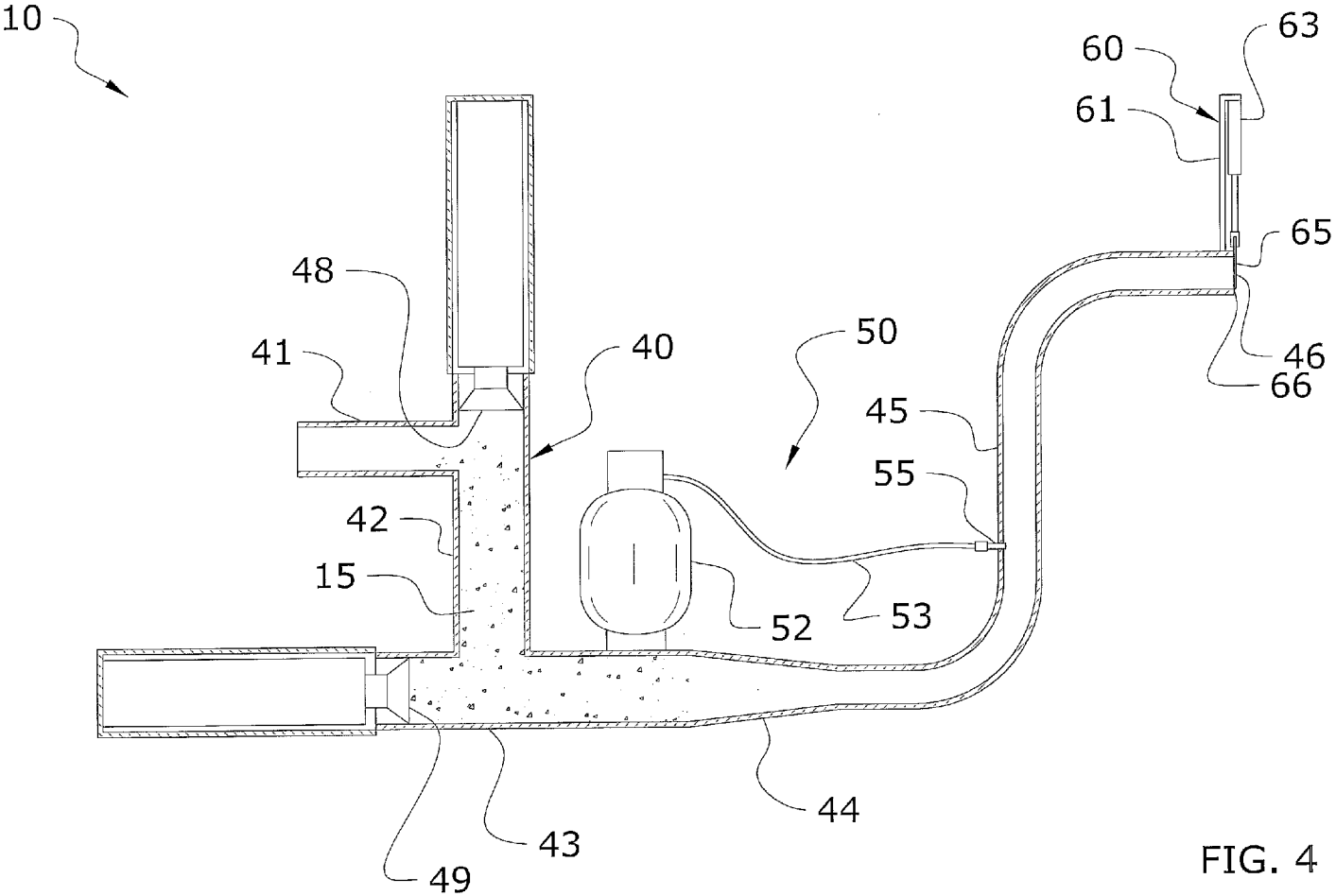
FIG. 4 is a side sectional view of the compressor where first and second segments of the compression tube are filled with loose biomass.
Figure 5:
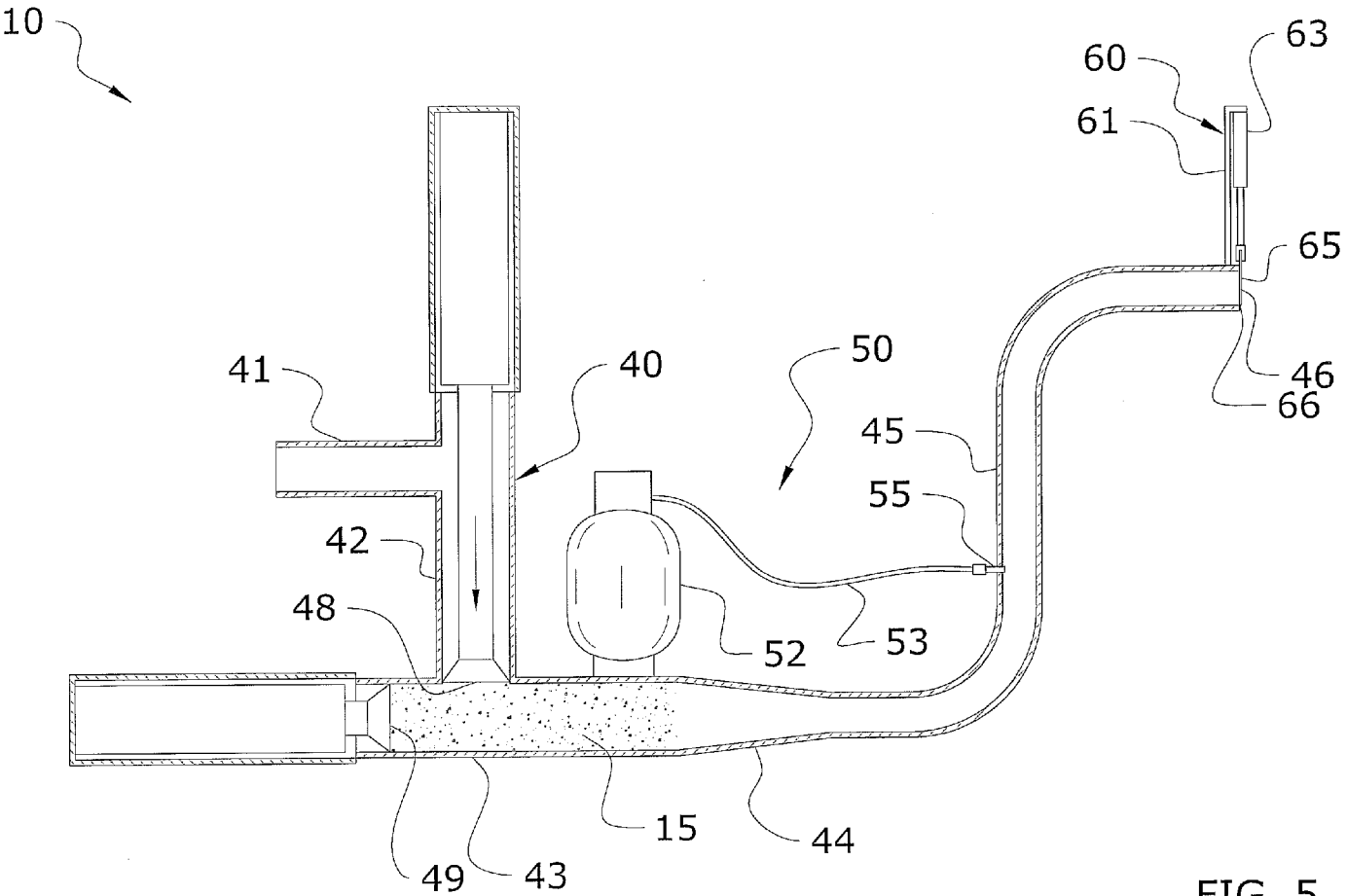
FIG. 5 is a side sectional view of the compressor where first compacting device is compacting the loose biomass within the first segment into the second segment.

In use, the harvester 20 first harvests the biomass 15 and directs the biomass 15 to the conveyor 24 where the biomass 15 is transferred to the compressor 30. The manifold 31 of the compressor 30 then receives the biomass 15 and the valve 34 operates to direct the loose biomass 15 into a chosen compression tube 40 of the compressor 30 that is ready to receive the biomass 15. The biomass 15 is then directed into the first segment 42 and continually fed into the first segment 42 as the first segment 42 and the second segment 43 fill with the loose biomass 15 as illustrated in FIGS. 3 and 4.

Once the first segment 42 and the second segment 43 are substantially filled with the loose biomass 15 a compacting stage of the compression cycle begins and the first compacting device 48 activates to compress the loose biomass 15 within the first segment 42 toward the second segment 43 thus compacting the loose biomass 15. The first compacting device 48 preferably extends throughout the first segment 42 all the way to the second segment 43.

Figure 6:
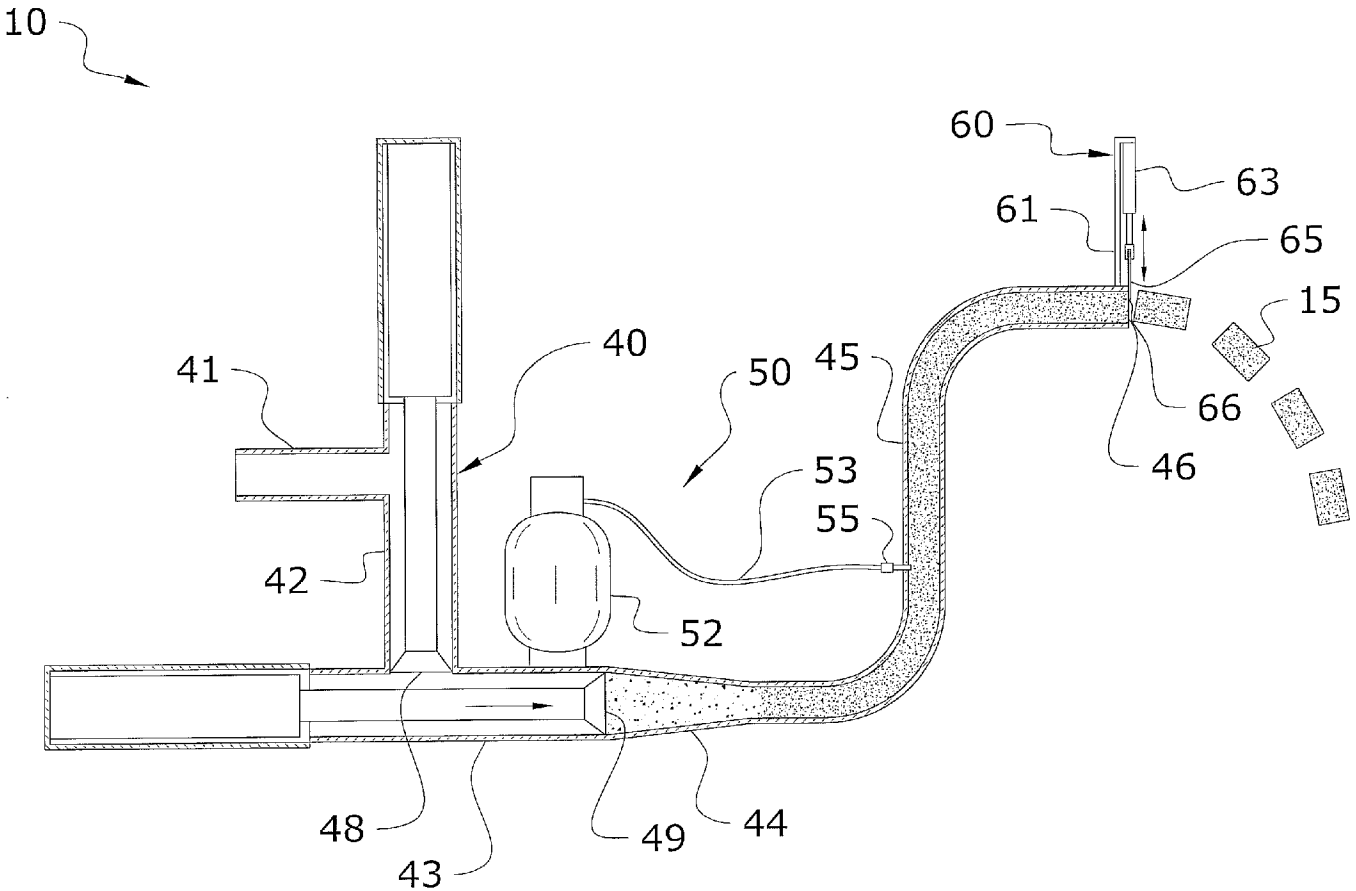
FIG. 6 is a side sectional view of the compressor where second compacting device is forcing the biomass through the tapered portion and through the third segment where it is subsequently frozen and cut.
Figure 7:
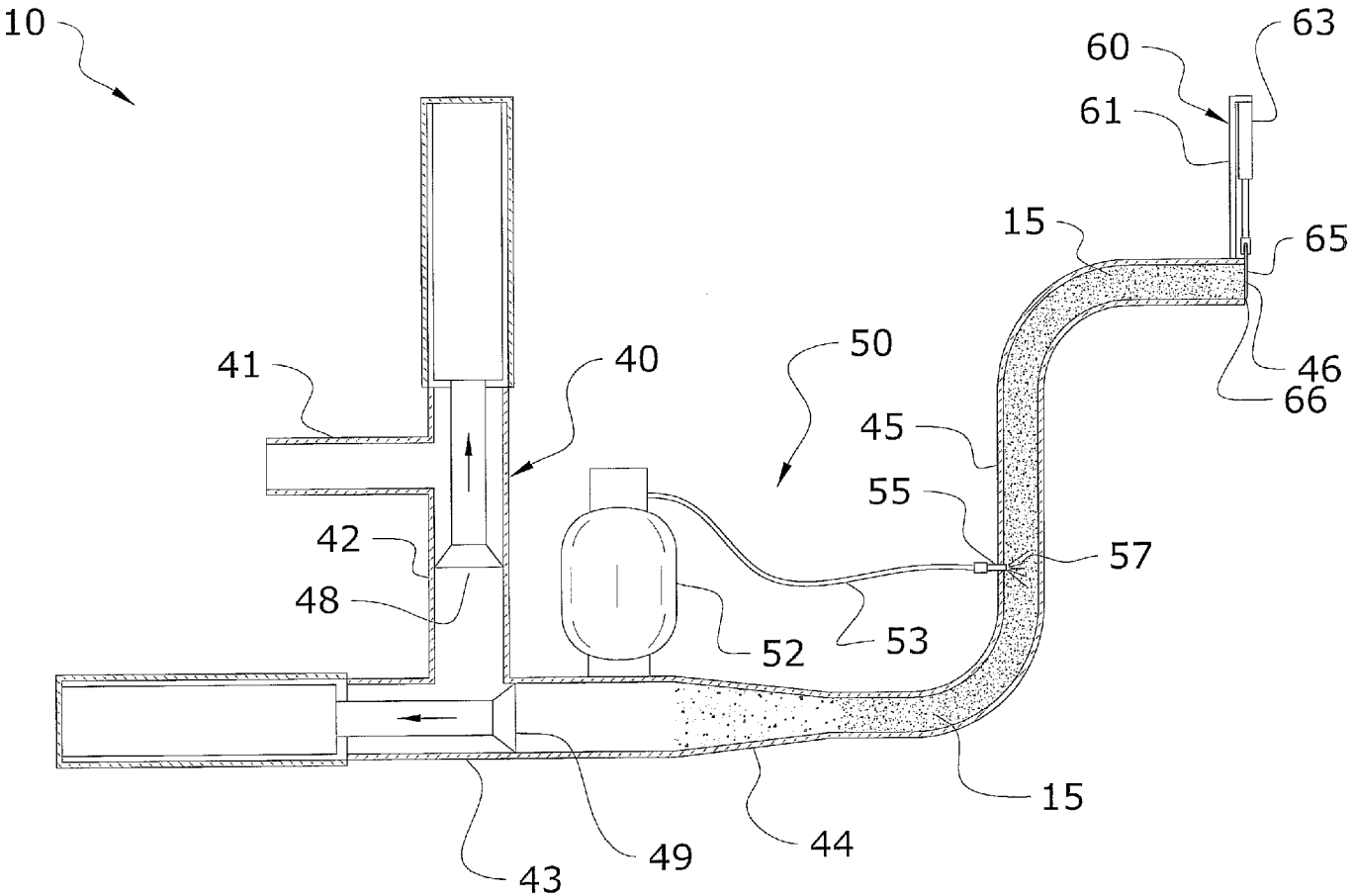
FIG. 7 is a side sectional view of the compressor where the first and second compacting devices are retracting to allow for a new load of loose biomass to be filled within the first and second segments and where the freezing assembly is freezing the biomass within the third segment.
Figure 8:
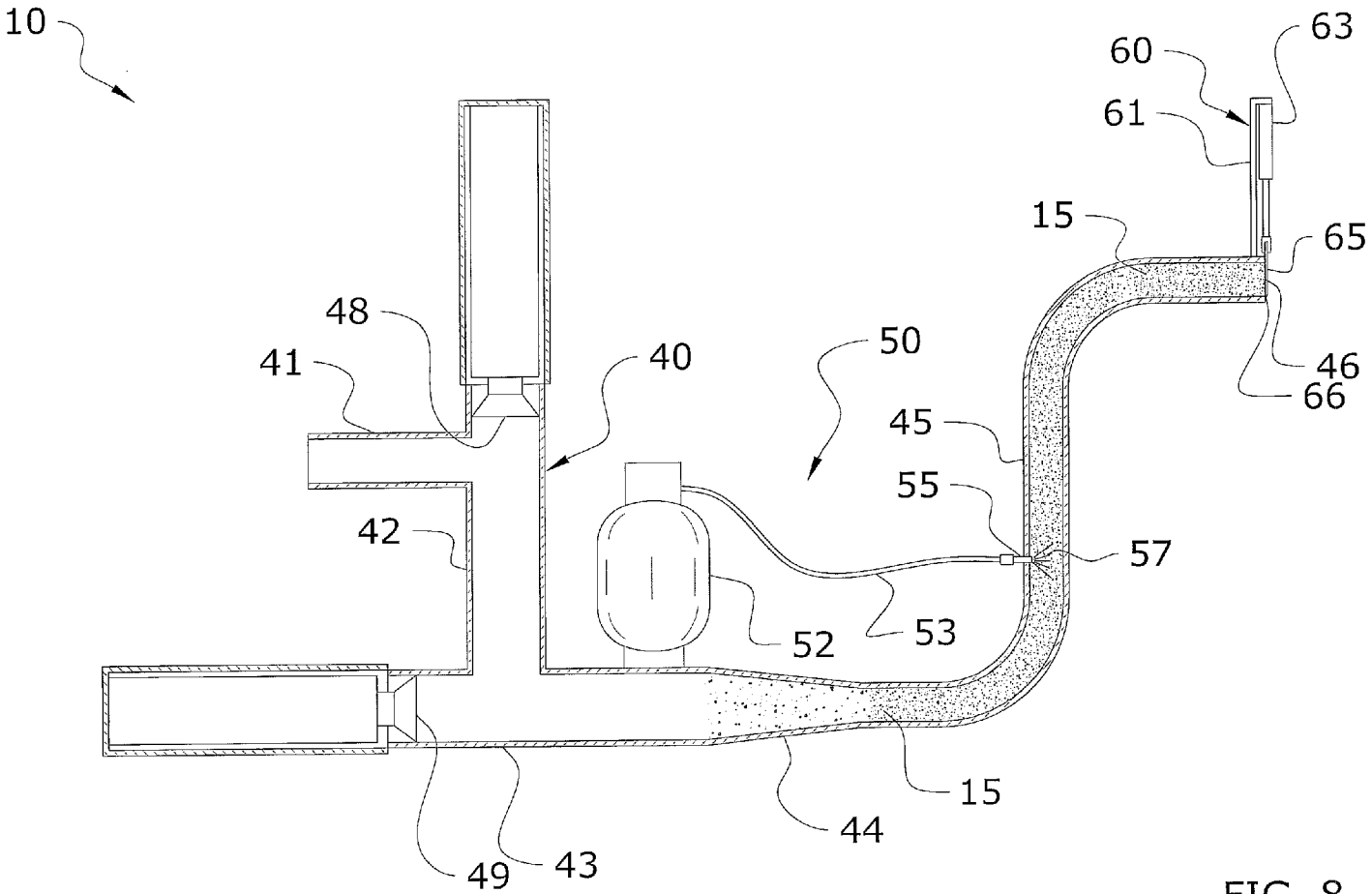
FIG. 8 is a side sectional view of the compressor where the first and second compacting devices are retracted to allow for a new load of loose biomass to be filled within the first and second segments and where the freezing assembly is freezing the biomass within the third segment.

While the first compacting device 48 remains in an extended position to secure the biomass 15 in the second segment 43, the second compacting device 49 extends outwards to the push the compacted biomass 15 into the tapered portion 44 to further compact the biomass 15 and then into the third segment 45 as illustrated in FIG. 6. Once the compacted biomass 15 is within the tapered portion 44 and third segment 45, the compacting stage of the cycle ends and the compacting devices retract so that additional amounts of loose biomass 15 may be received within the first segment 42 and the second segment 43.

The freezing or cooling stage of the cycle begins and the coolant 57 from the tank 52 of the freezing assembly 50 is directed within the third segment 45 to contact the compacted biomass 15. The coolant 57 freezes the biomass 15 in the short term which acts to further hold the biomass 15 together in a compressed and dense form long enough to handle. The amount of liquid sprayed or deposited within the third segment 45 onto the biomass 15 may vary with the amount of biomass 15 within the third segment 45.

As the frozen and compacted biomass 15 passes through the outlet 46 of the compressor 30, the cutting mechanism 60 acts to chop the biomass 15 into smaller sized pieces as illustrated in FIG. 6 so that the biomass 15 may be more efficiently deposited within the wagon 70 and handled when transporting, storing, selling, or measuring. Each of the pieces of compressed biomass 15 cut by the cutting mechanism 60 are preferably of a similar size which may be determined by the rate of flow of the biomass 15 through the compressor 30 or various other types of sensors. It is appreciated that the biomass 15 is pushed through the third segment 45 and through the outlet 46 via further amounts of biomass 15 compacted via the compacting devices 48, 49.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A compressor for the compression of loose material, comprising:

at least one compression tube;

wherein at least one compression tube includes a first segment, a second segment intersecting with said first segment, a tapered portion extending from said second segment, and a third segment extending from said tapered portion;

a first compacting device connected to said first segment, wherein said first compacting device extends in a vertical manner through said first segment;

a second compacting device connected to said second segment, wherein said second compacting device extends in a horizontal manner through said second segment;

wherein said first compacting device and said second compacting device are comprised of hydraulic cylinders;

wherein said first compacting device and said second compacting device compact a compressible material within said first and second segment during a compacting stage of a compression cycle;

a freezing assembly connected to a vertical portion of said third segment;

wherein said freezing assembly includes a tank to supply a coolant to within said third segment;

wherein said freezing assembly freezes said compressible material within said third segment during a freezing stage of said compression cycle; and a cutting mechanism including an actuator and a reciprocating blade located adjacent an outlet of said third segment;

wherein said cutting mechanism cuts a compressed said compressible material.

* * * * *